US007938658B1

(12) United States Patent
Zeng et al.

(10) Patent No.: US 7,938,658 B1
(45) Date of Patent: May 10, 2011

(54) CARD EDGE CONNECTOR WITH A FASTENER WITH A DETENT PORTION WITH A SNAP-FITTING SURFACE

(75) Inventors: Xian Ju Zeng, Guangzhou (CN); Yong Fu Wang, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/777,664

(22) Filed: May 11, 2010

(30) Foreign Application Priority Data

Jan. 15, 2010 (CN) ..... 2010 2 0002091 U

(51) Int. Cl.
*H01R 13/62* (2006.01)

(52) U.S. Cl. ..... 439/160

(58) Field of Classification Search ..... 439/62, 439/153, 157, 159, 160
See application file for complete search history.

(56) References Cited

U.S. PATENT DOCUMENTS 5,445,531 A * 8/1995 Billman et al. ..... 439/160
6,152,749 A * 11/2000 Tseng et al. ..... 439/160
7,083,448 B2 * 8/2006 Tanigawa ..... 439/160
7,645,150 B1 * 1/2010 Chang ..... 439/157
2003/0137811 A1 * 7/2003 Ling et al. ..... 361/759
2005/0196992 A1 * 9/2005 Tanigawa ..... 439/160
2010/0062648 A1 * 3/2010 Guan et al. ..... 439/630

FOREIGN PATENT DOCUMENTS

CN 03226043.1 5/2004

* cited by examiner

*Primary Examiner* — Chandrika Prasad
(74) *Attorney, Agent, or Firm* — Muncy, Geissler, Olds & Lowe, PLLC

(57) ABSTRACT

The card edge connector includes: an electrical receptacle formed with an abutting surface; two fasteners pivoted to the electrical receptacle, wherein each of the fasteners is formed with a snap-fitting surface that makes contact with the fastened surface to form a fastening area, the fastening area has a contact point that is closest to a central perpendicular line of the electrical receptacle, and the contact point has a first distance from the central perpendicular line; and wherein each of the fasteners is provided with an abutting portion, and when the abutting portion abuts against the abutting surface correspondingly, an abutting area is formed which has an abutting point that is closest to the central perpendicular line of the electrical receptacle, and the abutting point has a second distance from the central perpendicular line that is less than the first distance.

20 Claims, 11 Drawing Sheets

CARD EDGE CONNECTOR WITH A FASTENER WITH A DETENT PORTION WITH A SNAP-FITTING SURFACE

BACKGROUND OF THE INVENTION

1. Field of the Invention

The present invention relates to a card edge connector with a card-disengagement-preventing function, and in particular, to a card edge connector with a card-disengagement-preventing function that is adapted to electrically connect an electronic card to a circuit board.

2. Description of Related Art

A conventional receptacle comprises a body for an external component (e.g., a memory chip) to be inserted therein. The body is formed with two rotary holes at two ends thereof respectively. At two ends of the body, two ear clips are pivoted respectively, each of which is provided with two rotary shafts and a detent portion. Each of the rotary shafts is pivoted into a corresponding one of the rotary holes, and the detent portion is fastened to the external component for purpose to fix the external component.

However, during the process of assembling different electronic components, if the external component has already been assembled onto the receptacle, then the external component may sometimes been touched accidentally when other assembling steps are being performed. Because the receptacle has no other structures for fixing the external component but the detent portion, it is very likely that the external component will disengage from the receptacle in such a case.

In view of the aforementioned shortcomings, the present inventor has made an improvement on the receptacle. That is, as disclosed in China Patent Application CNO3226043.1, a receptacle "a" for an electronic card "b" to be inserted therein (as shown in FIG. 1) comprises a body a11 and two ear clips a12. The body a11 has two recesses a111 and two shaft holes a112 formed at two ends thereof respectively. Each of the ear clips a12 is pivoted to one end of the body a11 respectively, and is provided with two protrusions a121, two pivoting shafts a122 and a detent portion a123. Each of the protrusions a121 is disposed in a corresponding one of the recesses a111 with a first gap L1 being left therebetween; each of the pivoting shafts a122 is disposed in a corresponding one of the shaft holes a112 with a second gap L2 being left therebetween, which is greater than or equal to the first gap L1; and the detent portion a123 is fastened to the electronic card "b".

In case the electronic card "b" is ejected out under an external force, because the second gap L2 is greater than or equal to the first gap L1, an upper surface of each protrusion a121 will abut against an upper surface of the corresponding recess a111 before the pivoting shafts a122 reach the top of the shaft holes a112, thereby preventing the pivoting shafts a122 from continuing moving upward and, consequently, preventing the pivot shafts a122 from pivoting outwards after making contact with the top portion of the shaft holes a122. Thus, disengagement of the electronic card "b" from the receptacle "a" is prevented.

Although by making the second gap L2 to be greater than or equal to the first gap L1 in the receptacle "a", an effect of preventing disengagement of the electronic card "b" is achieved to some extent, this solution still suffers from the following disadvantages.

The electronic card "b" may be mistakenly pulled upward unexpectedly, and after the electronic card "b" is pulled upward, each of the ear clips a12 is subjected to an external force opposite to a direction in which the electronic card "b" is inserted. As a first position c1 where the electronic card "b" mates with the detent portion a123 and a second position c2 where the recess a111 mates with the protrusion a121 have the same distance from the central perpendicular line (not shown), a torque corresponding to the external force is generated for the ear clip a12, with the protrusion a121 as a fulcrum, to drive the ear clip a12 to rotate in a direction towards or away from the central perpendicular line, making it possible for the ear clip a12 to rotate towards or away from the central perpendicular line. However, in the above reference, it is impossible for the ear clip a12 to rotate towards the central perpendicular line because no clearance that is closer to the central perpendicular line than the pivoting shaft a122 is provided in a lateral direction between the shaft hole a112 and the pivoting shaft a122. Due to lack of the clearance that allows for rotation of the ear clip a12, the ear clip a12 is unable to rotate towards the central perpendicular line but only able to rotate away from the central perpendicular line, so it is still likely to cause disengagement of the electronic card "b" from the receptacle "a".

In summary, the conventional receptacle "a" is not the optimal technical solution for fixing the electronic card "b". In view of the afore-mentioned shortcoming, the present inventor thinks it necessary to make further refinement on the structure of the receptacle "a" in order to provide an improved receptacle "a" for fixing the electronic card "b" more effectively.

Accordingly, it is necessary to design a novel receptacle for fixing the electronic card more securely.

SUMMARY OF THE INVENTION

An objective of the present invention, which is an improvement made on the above-mentioned technical solution, is to provide a card edge connector with a card-disengagement-preventing function that is capable of preventing disengagement of an electronic card more effectively.

To achieve the above-mentioned objective, in a core technology employed in an embodiment of the present invention, both sides of an electronic card are provided respectively with a snap-fitting portion, which is formed with a fastened surface. The card edge connector with a card disengagement-preventing function according to the present invention consists of an electrical receptacle and two fasteners. The electrical receptacle is formed with a slot for the electronic card to be inserted therein, and each of the two sides of the electrical receptacle extends upward to form a tower portion for receiving the corresponding fastener, and the tower portion is formed with an abutting surface that faces downward; the two fasteners are movably pivoted to the electrical receptacle by means of respective pivot portions thereof. Each of the fasteners is provided with a detent portion which is formed with a snap-fitting surface, and when the detent portion pivots about the pivot portion to be snap-fitted with the snap-fitting portion, the snap-fitting surface is exactly located above and makes contact with the fastened surface to form a fastening area. The fastening area comprises a contact point that is closest to a central perpendicular line of the electrical receptacle, and the contact point has a first distance from the central perpendicular line. Between the pivot portion and the detent portion, the fastener is provided with an abutting portion which, when the detent portion is snap-fitted with the snap-fitting portion, is exactly located beneath an abutting surface. When a top surface of the abutting portion abuts against an abutting surface, an abutting area is formed which comprises an abutting point that is closest to the central perpendicular line, and the abutting point has a second distance from the central perpendicular line that is less than the first distance. Through this structural design in which the contact point and the abutting point are disposed at different positions, before the fastener is operated to be detached from the snap-fitting portion, in case the electronic card is subjected to a force opposite to a direction in which the electronic card is inserted, the fastened surface of the electronic card will push against the snap-fitting surface to drive the abutting point of the abutting portion to abut against the abutting surface correspondingly, and with the abutting point as a fulcrum, a torque is generated from the abutting force to rotate the fastener towards the central perpendicular line.

As compared to the prior art, the card edge connector with a card-disengagement-preventing function of the present invention has the following benefits:

Under conditions that the fastener is normally fastened into the electronic receptacle, once the electronic card is subjected to a force opposite to the direction in which the electronic card is inserted, the electronic card will be driven to move upward and, because the fastened surface of the electronic card abuts against the snap-fitting surface of the fastener, the fastener will also move upward. When the fastener moves upward to a certain height, the top surface of the abutting portion will abut against the abutting surface correspondingly to prevent further upward movement of the fastener. As the distance between the contact point and the central perpendicular line (i.e., the first shortest distance) is greater than the distance between the abutting point and the central perpendicular line (i.e., the second shortest distance), a torque is generated from the force to rotate, with the abutting point as a fulcrum, the fastener towards the central perpendicular line. Under the action of the torque, the fastener rotates towards the central perpendicular line to ensure that the detent portion and the snap-fitting portion are snap-fitted with each other, thereby preventing disengagement of the electronic card from the electrical receptacle.

For better understanding of the objectives, shapes, constructions, characteristics and effects of the present invention, a detailed description will now be made with reference to embodiments thereof and the attached drawings.

DETAILED DESCRIPTION OF THE PREFERRED EMBODIMENTS

Hereinafter, the card edge connector with a card-disengagement-preventing function according to the present invention will be further described with reference to the attached drawings and embodiments thereof.

Figure 1:
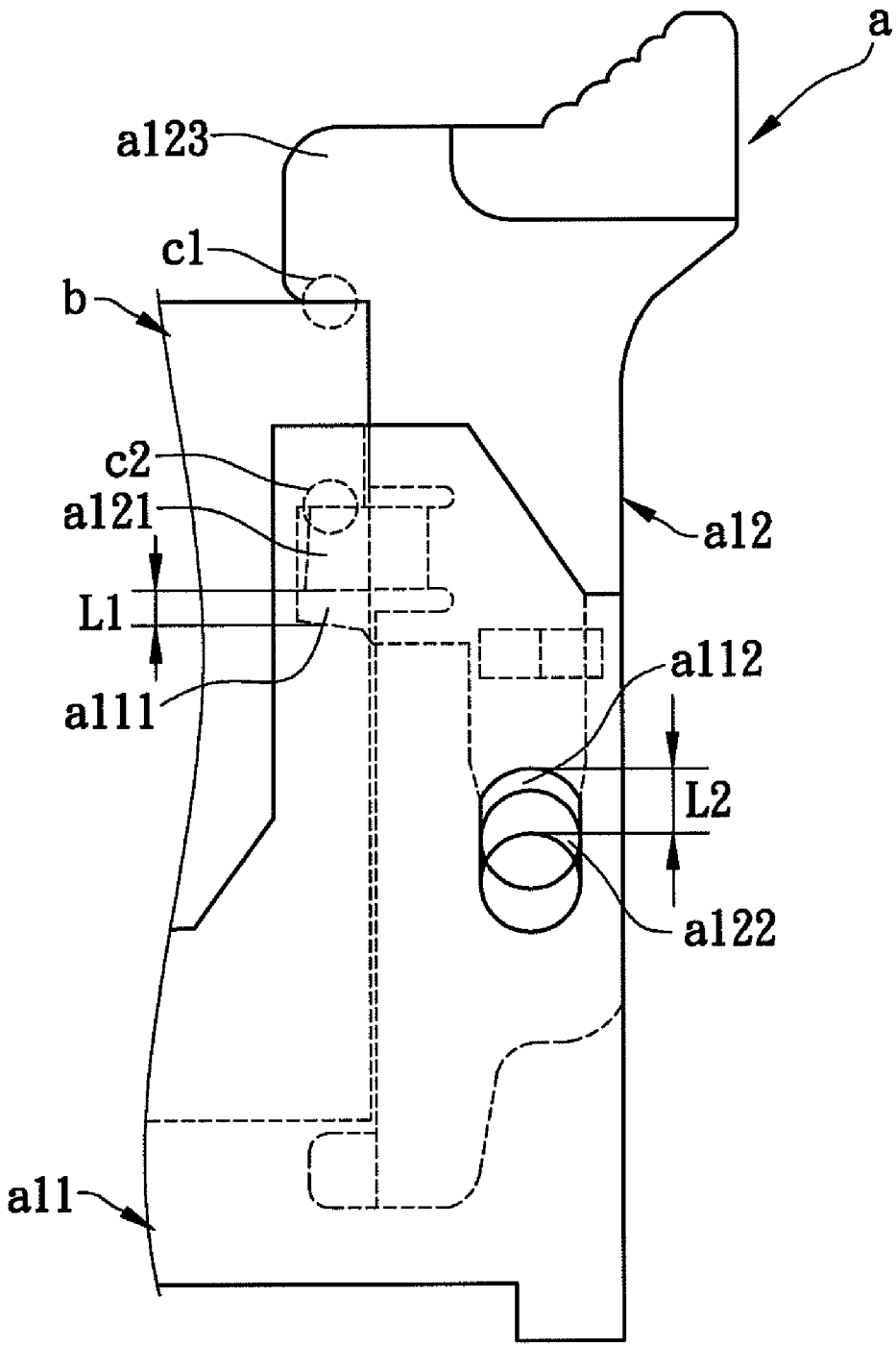
FIG. 1 PRIOR ART
FIG. 1 is a schematic view illustrating engagement between a prior art receptacle and an electronic card.
Figure 2:
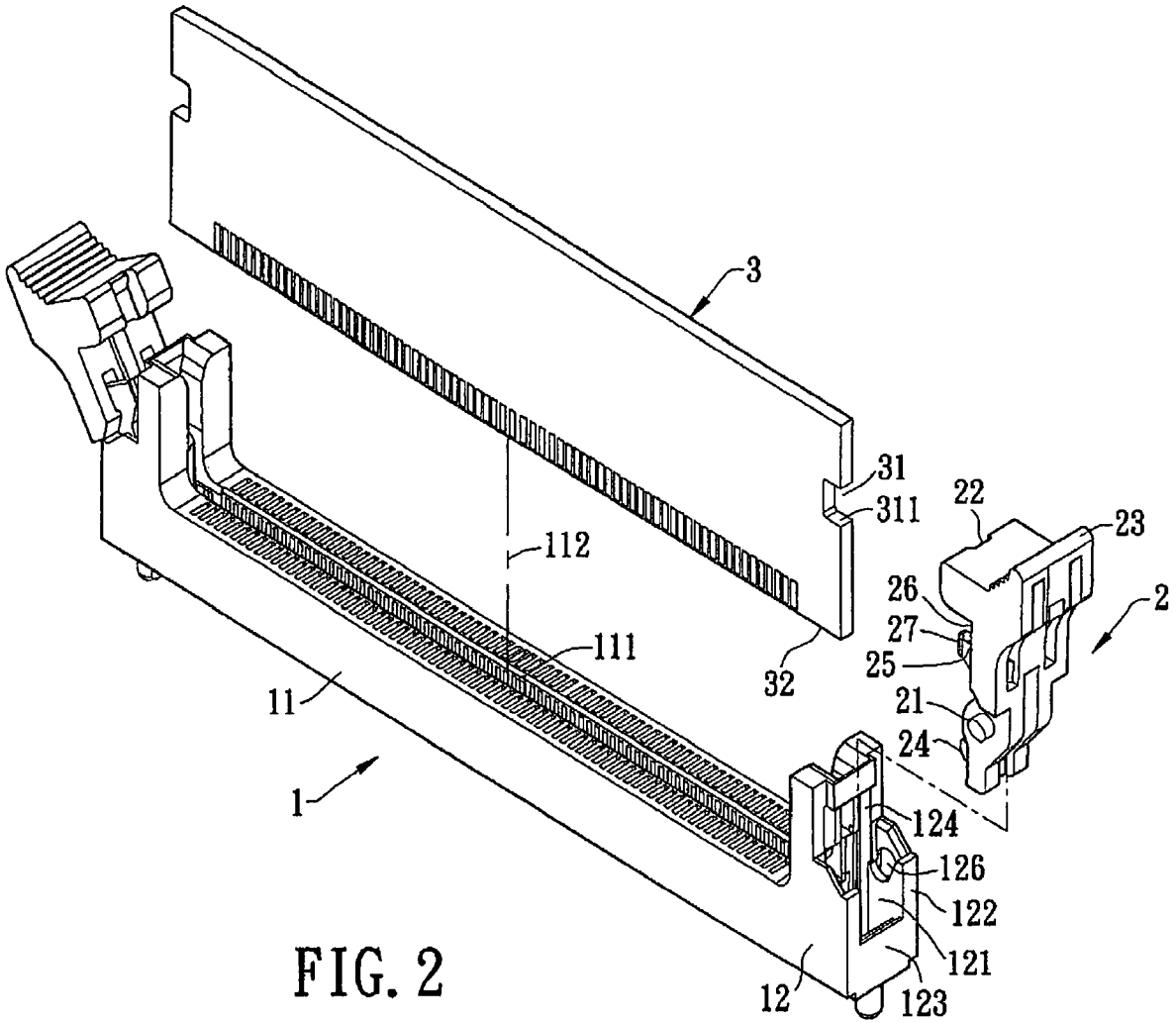
FIG. 2 is a partial exploded view illustrating engagement between a card edge connector with a card-disengagement-preventing function of a first embodiment of the present invention and an electronic card.
Figure 3:
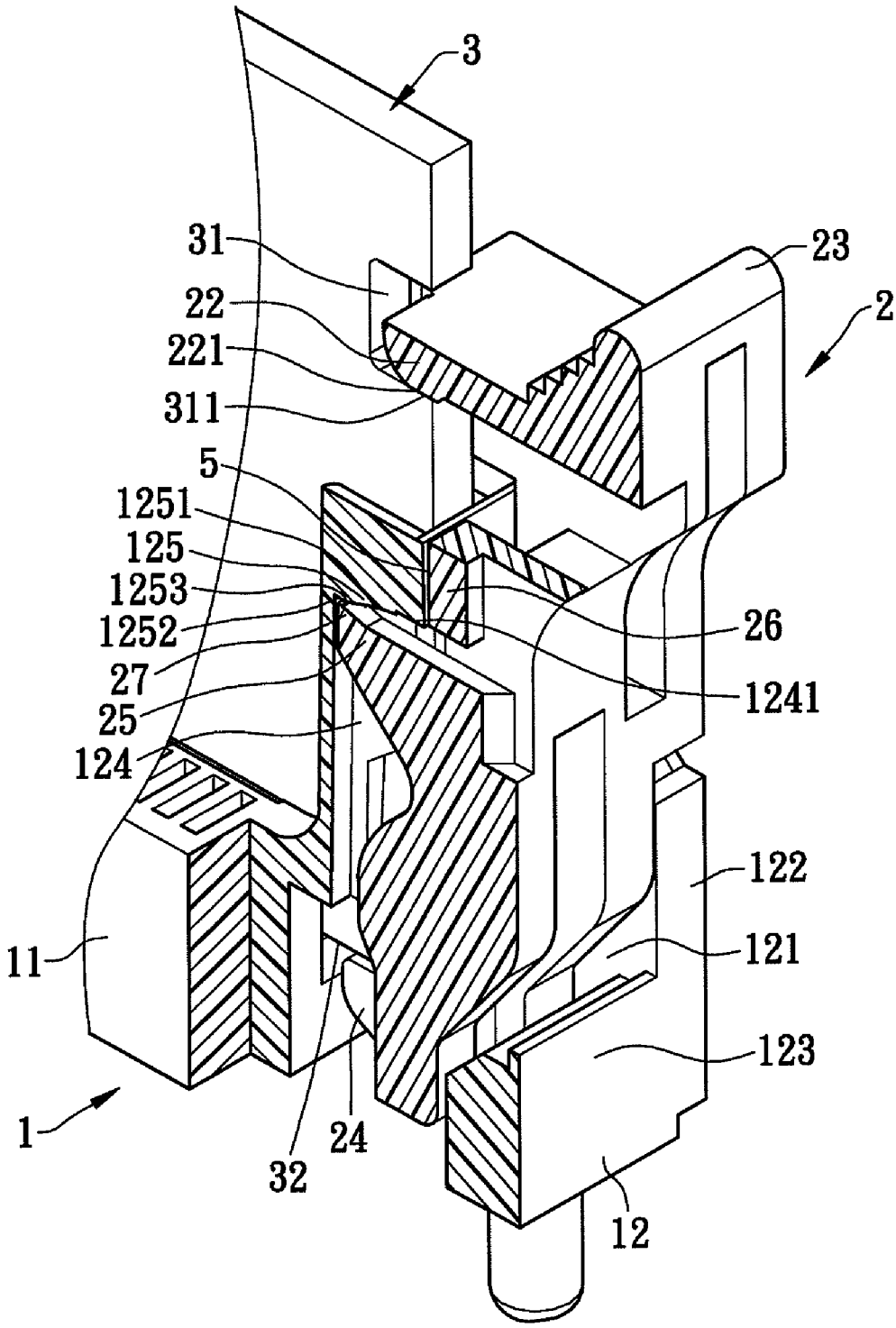
FIG. 3 is a partial cross-sectional view illustrating engagement between a card edge connector with a card-disengagement-preventing function of the first embodiment of the present invention and an electronic card.
Figure 4:
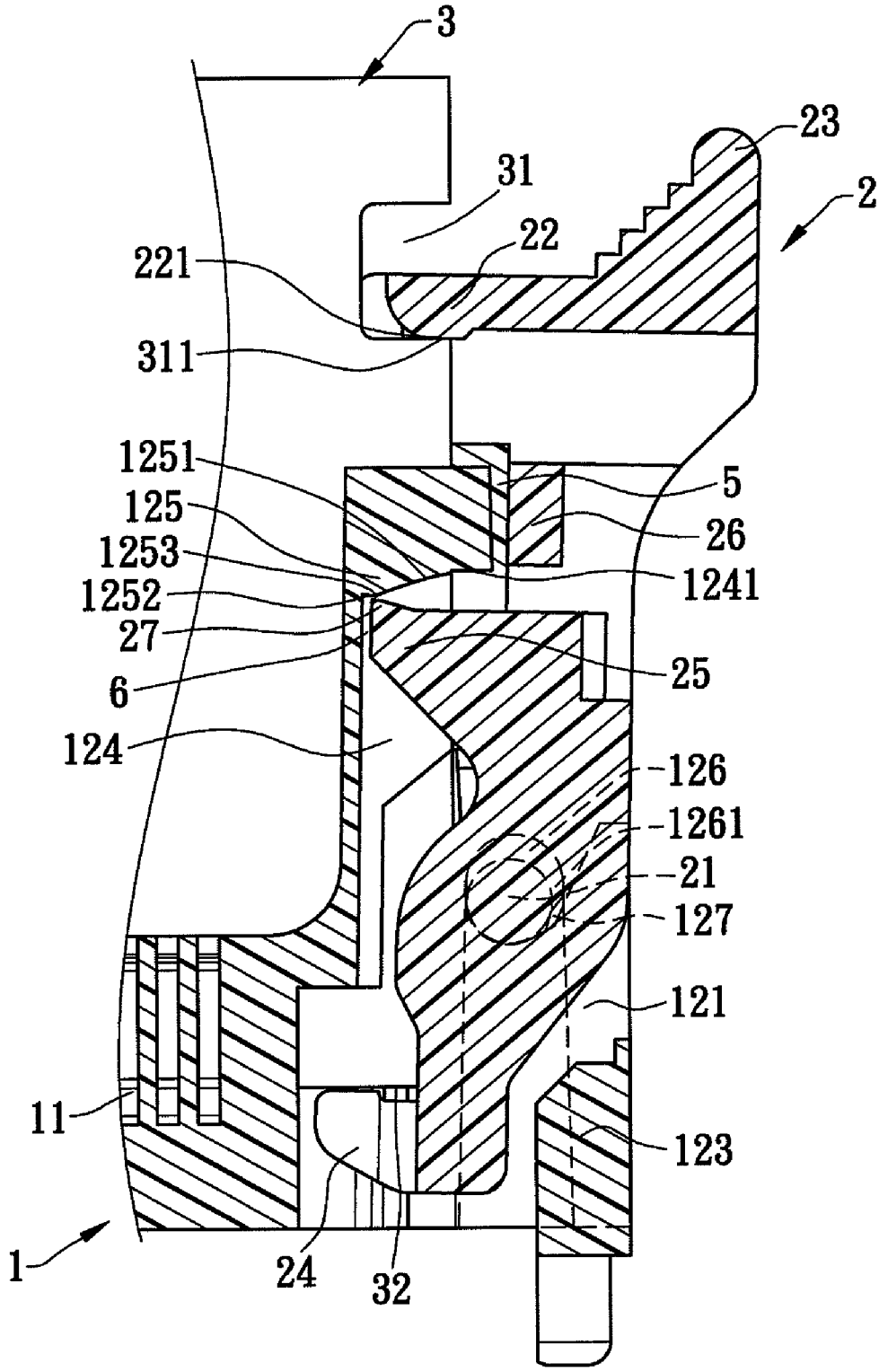
FIG. 4 is a front view illustrating engagement between the card edge connector with a card-disengagement-preventing function and an electronic card shown in FIG. 3.

Referring to FIGS. 2 to 4, a first embodiment of the card edge connector with a card-disengagement-preventing function of the present invention is shown therein. The card edge connector with a card-disengagement-preventing function comprises an electrical receptacle 1 and two fasteners 2.

The electrical receptacle 1, which is made of an insulation material such as a plastic material, allows for an electronic card 3 to be inserted therein, and has a generally cuboidal base 11 and two tower portions 12.

The base 11 has a slot 111, which is open upwards, in a central portion thereof for the electronic card 3 to be inserted therein. Further, the base 11 has a central perpendicular line 112.

Each of the tower portions 12, which is formed at one lateral end of the base 11 and extends upward vertically, is formed with a chamber 121 for receiving a corresponding one of the fasteners 2, with the chamber 121 communicating with the slot 111. Each of the tower portions 12 is formed with a pair of sidewalls 122 and an end wall 123 that connects with the pair of sidewalls 122. The pair of sidewalls 122 and the end wall 123 jointly enclose the chamber 121.

Each of the sidewalls 122 is formed with a recess 124 having an inner top end 1241. A projection 125 projects downwards from the inner top end 1241 and has an inclined surface 1251 that is inclined downwards towards the central perpendicular line 112. A bottom end of the inclined surface 1251 is bent to form an abutting surface 1252, which is a slope surface inclined downwards away from the central perpendicular line 112, and a first connecting portion 1253 is formed at the bending position.

Each of the sidewalls 122 is formed with an elliptical pivot hole 126 near the end wall 123, and a positioning block 127 is provided at the bottom of the pivot hole 126 away from the central perpendicular line 112.

Each of the fasteners 2 is pivoted to a corresponding one of the tower portions 12 respectively and snap-fitted to the electrical receptacle 1. Two side surfaces of a bottom end of each fastener 2 are formed with a pivot portion 21 respectively to mate with the pivot hole 126. By disposing the pivot portions 21 into the corresponding pivot holes 126, the fastener 2 is pivoted to the tower portion 12 so that the fastener 2 can rotate with respect to the electrical receptacle 1 in a slidably mating relationship therebetween. In this embodiment, the pivot portions 21 are pivots extending from two opposite sides of the fastener 2.

At a lateral side of the top end of the fastener 2 is disposed a detent portion 22 for fixing the electronic card 3, which is formed with a snap-fitting surface 221. At the other lateral side of the fastener 2 is disposed an operational portion 23 opposite to the detent portion 22. When being pulled, the operational portion 23 allows the fastener 2 to be snap-fitted into or detached from the electrical receptacle 1. At a lateral side of the bottom end of the fastener 2 is disposed an ejecting portion 24 extending towards the same direction as the detent portion 22. The ejecting portion 24 is disposed in the chamber 121 and adapted to eject the electronic card 3 when it is desired to detach the fastener 2 from the electrical receptacle 1.

Two symmetrical abutting portions 25, which are disposed parallel to each other or extend away from each other gradually, are disposed on the fastener 2 between the detent portion 22 and the pivot portion 21 at the same lateral side as the detent portion 22, and a connecting section 26 is disposed between the two abutting portions 25 and the detent portion 22. When the fastener 2 is snap-fitted into the electrical receptacle 1, each of the abutting portions 25 is driven into the corresponding recess 124 and located exactly below the projection 125. Furthermore, a protrusion 27 protrudes upward from each of the abutting portions 25 to mate with the abutting surface 1252.

A snap-fitting portion 31 is disposed on a left side and a right side of the electronic card 3 respectively to mate with a corresponding one of the detent portions 22. The snap-fitting portion 31 is formed with a fastened surface 311 which, when the fastener 2 is fastened into the electrical receptacle 1, is located exactly beneath and makes contact with the snap-fitting surface 221. Additionally, the electronic card 3 is formed with a bottom edge 32, two ends of which are disposed corresponding to the ejecting portions 24.

Referring to FIGS. 2 to 4, during the assembling process, firstly, the two fasteners 2 are inserted obliquely into the corresponding tower portions 12 respectively in such a way that each of the pivot portions 21 is disposed in the corresponding pivot hole 126 with a clearance 1261 being formed in a lateral direction between the pivot hole 126 and the pivot portion 21. The clearance 1261 is farther away from the central perpendicular line 112 than the pivot portion 21. Disposition of the clearance 1261 allows the pivot portion 21 to rotate within the pivot hole 126 correspondingly when the fastener 2 is rotating towards the central perpendicular line 112, thereby obviating the shortcoming that the pivot portions 21 and, consequently, the fastener 2 are unable to rotate due to lack of the clearance 1261. This further improves the snap-fitting capability by enhancing the effect of rotating the fastener 2 towards the central perpendicular line 112; also, this causes the positioning block 127 to be located at the lowermost position of the clearance 1261 and abut against the pivot portion 21, so that when being subjected to a extraordinary external force, the fastener 2 will move upward at first instead of towards a direction that tends to detach the fastener 2 from the electrical receptacle 1.

Then, the electronic card 3 is inserted into the slot 111 in such a way that both ends of the bottom edge 32 are located above the ejecting portions 24 respectively.

Finally, the operational portion 23 is pulled to fasten the fastener 2 to the tower portion 12: As a result, the detent portion 22 is snap-fitted into the snap-fitting portion 31, and the snap-fitting surface 221 makes contact with the fastened surface 311; a gap 5 is formed between the connecting section 26 and the tower portion 12 to provide a room for the fastener 2 to rotate towards the central perpendicular line 112 without being obstructed; the abutting portion 25 enters the recess 124 more conveniently because the downward inclination of the inclined surface 1251 towards the central perpendicular line 112 provides a room for the abutting portion 25 to enter the recess 124, which facilitates assembly of the fastener 2; the protrusion 27 corresponds to and mates with the abutting surface 1252 that is inclined away from the central perpendicular line 112 to facilitate a tight fit between the fastener 2 and the electrical receptacle 1; and a separation 6 exists in the lateral direction between the abutting portion 25 and the recess 124 to serve the same purpose as the gap 5. Thus, the assembling process of the present invention is completed.

Figure 5:
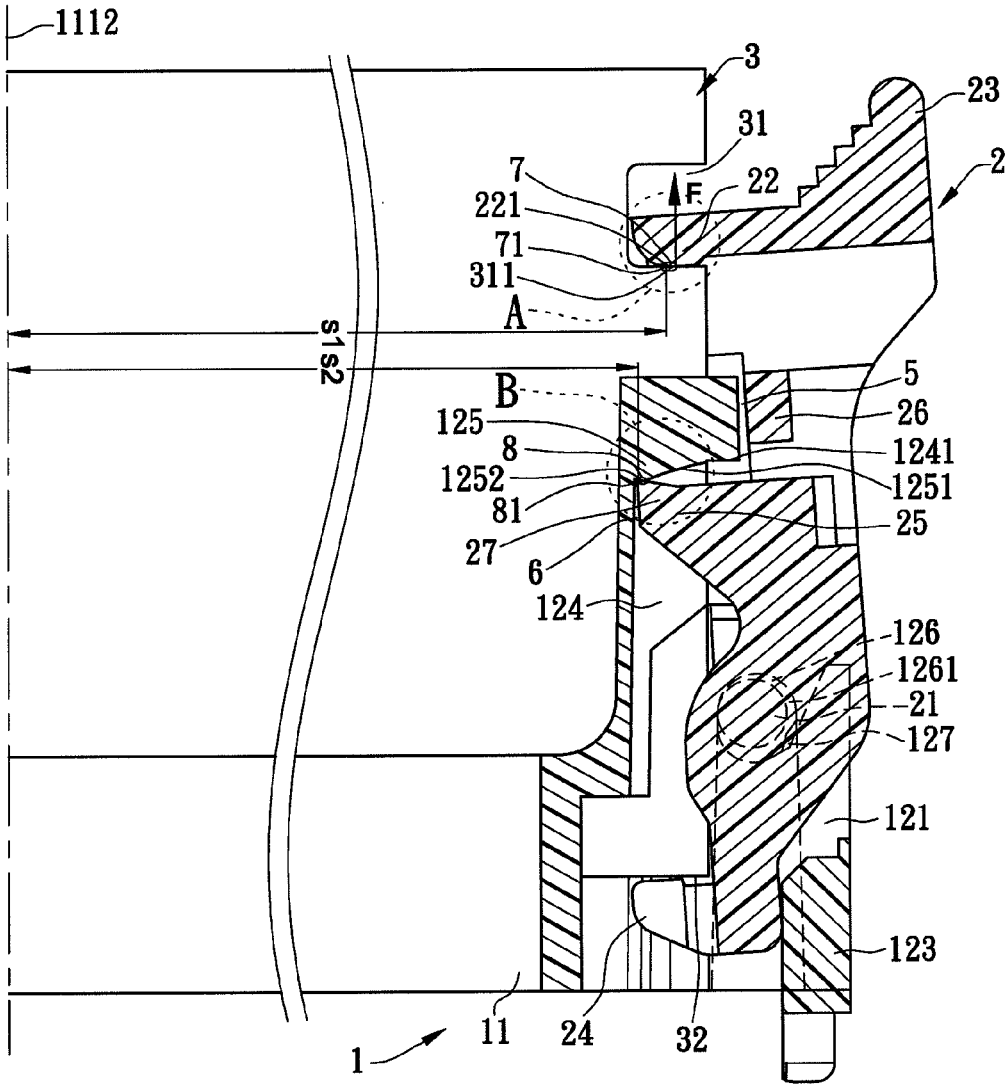
FIG. 5 is a schematic view illustrating rotation of a fastener towards a central perpendicular line if the electronic card is subjected to an external force when the card edge connector with a card-disengagement-preventing function engages with the electronic card.
Figure 6:
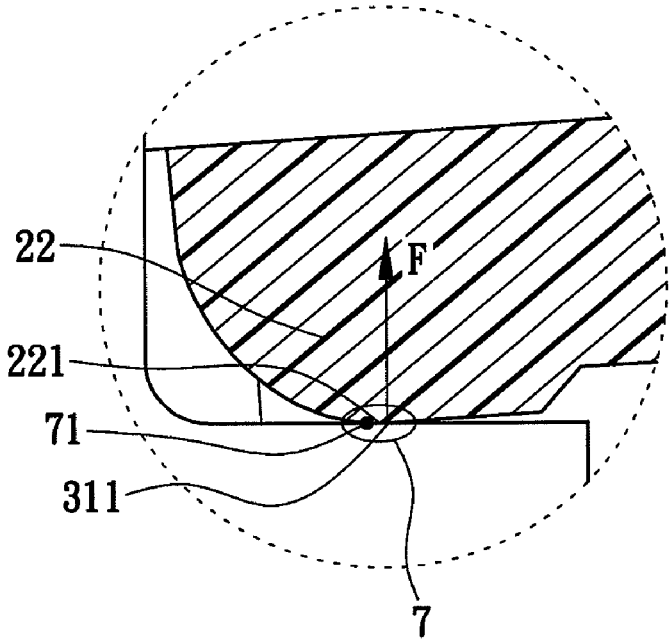
FIG. 6 is an enlarged view of a position A shown in FIG. 5.
Figure 7:
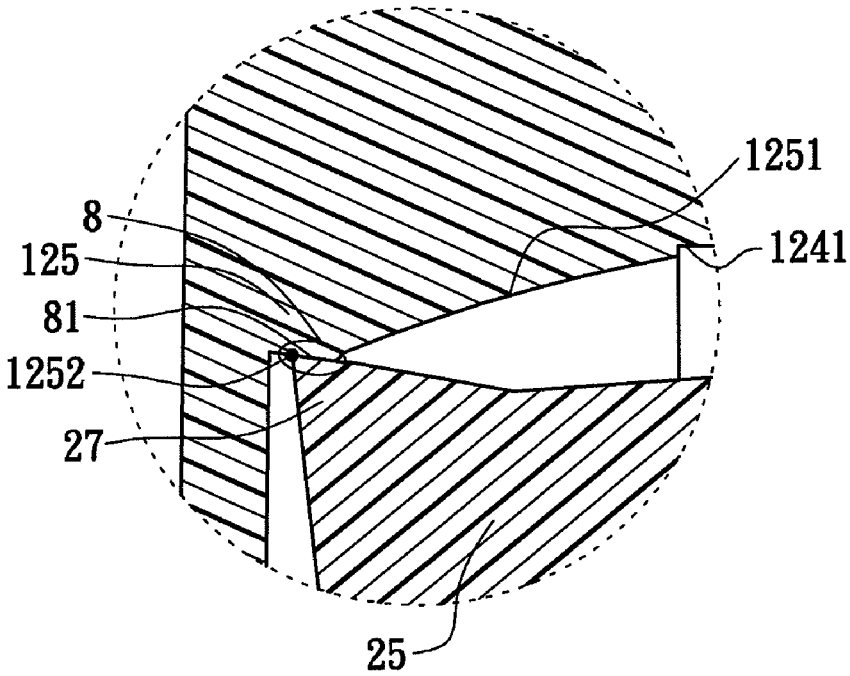
FIG. 7 is an enlarged view of a position B shown in FIG. 5.

Referring to FIGS. 5 to 7, before operating the fastener 2 to detach it from the snap-fitting portion 31, once the electronic card 3 is pulled opposite to the direction in which it is inserted into the electrical receptacle 1, the fastened surface 311 of the electronic card 3 will push against the snap-fitting surface 221 and apply an additional upward abutting force F thereto. In this case, the snap-fitting surface 221 makes contact with the fastened surface 311 to form a fastening area 7 therebetween. The fastening area 7 consists of a plurality of contact points 71 that are located on the snap-fitting surface 221 and the fastened surface 311 and have varied distances from the central perpendicular line 112. One of the contact points 71 that is closest to the central perpendicular line 112 has a first distance S1 (e.g. the shortest distance) from the central perpendicular line 112.

Meanwhile, under the action of the abutting force F, the fastener 2 is moved upward. Once the fastener 2 is moved to a certain height, the protrusion 27 will abut against the abutting surface 1252 to prevent the fastener 2 from further moving upward. At this point, the protrusion 27 makes contact with the abutting surface 1252 to form an abutting area 8. The abutting area 8 consists of a plurality of abutting points 81 that are located on the upper surface of the protrusion 27 and the abutting surface 1252 and have varied distances from the central perpendicular line 112. One of the abutting points 81 that is closet to the central perpendicular line 112 has a second distance S2 (e.g., the shortest distance) from the central perpendicular line 112 which is less than the first distance S1. Thus, with the abutting point 81 as a fulcrum, a torque corresponding to the abutting force F is generated on the fastener 2 to rotate the fastener 2 towards the central perpendicular line 112, thereby ensuring that the detent portion 22 and the snap-fitting portion 31 are snap-fitted with each other and improving the snap-fitting capability.

Figure 8A:
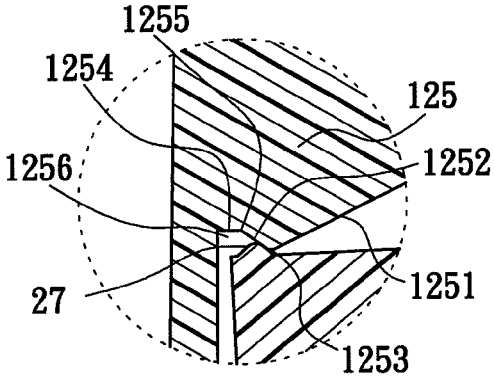
FIG. 8A is an enlarged view of a position C shown in FIG. 8.
Figure 8:
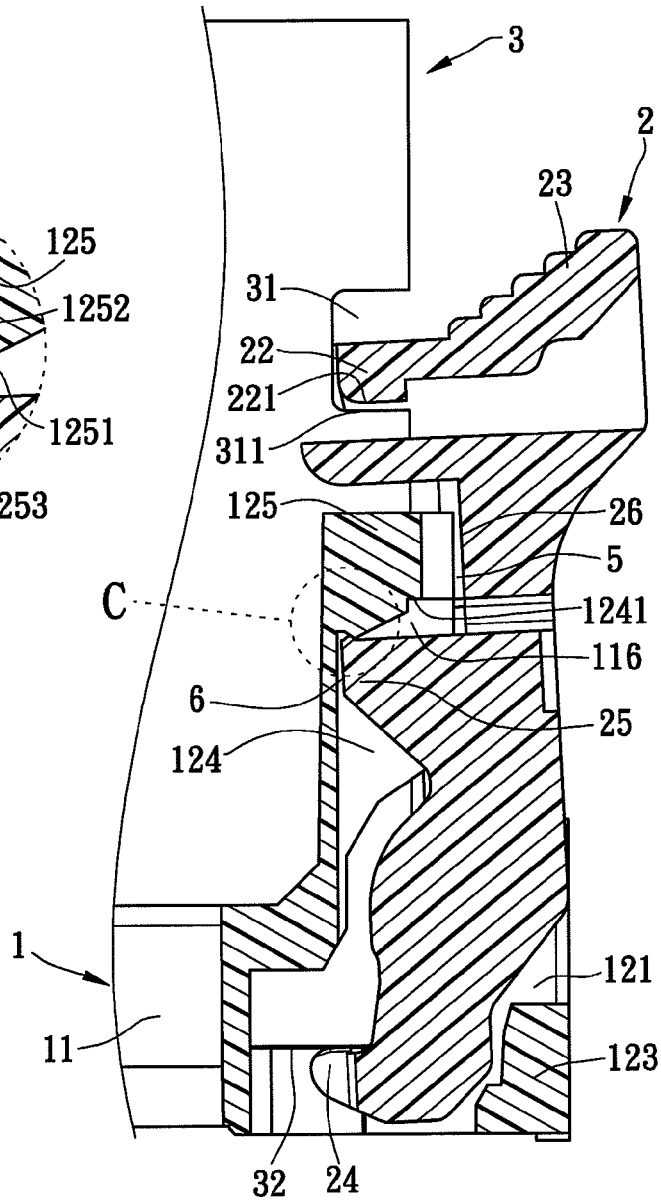
FIG. 8 is a front view illustrating engagement between a card edge connector with a card-disengagement-preventing function of a second embodiment of the present invention and an electronic card.
Figure 9A:
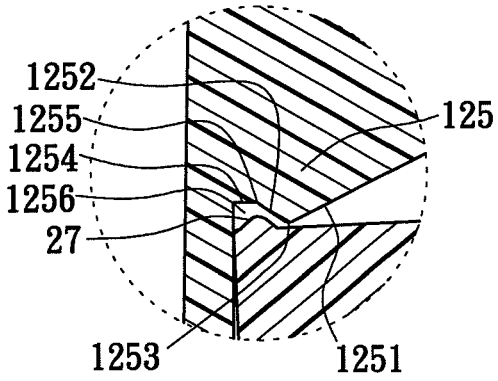
FIG. 9A is an enlarged view of a position D shown in FIG. 9.
Figure 9:
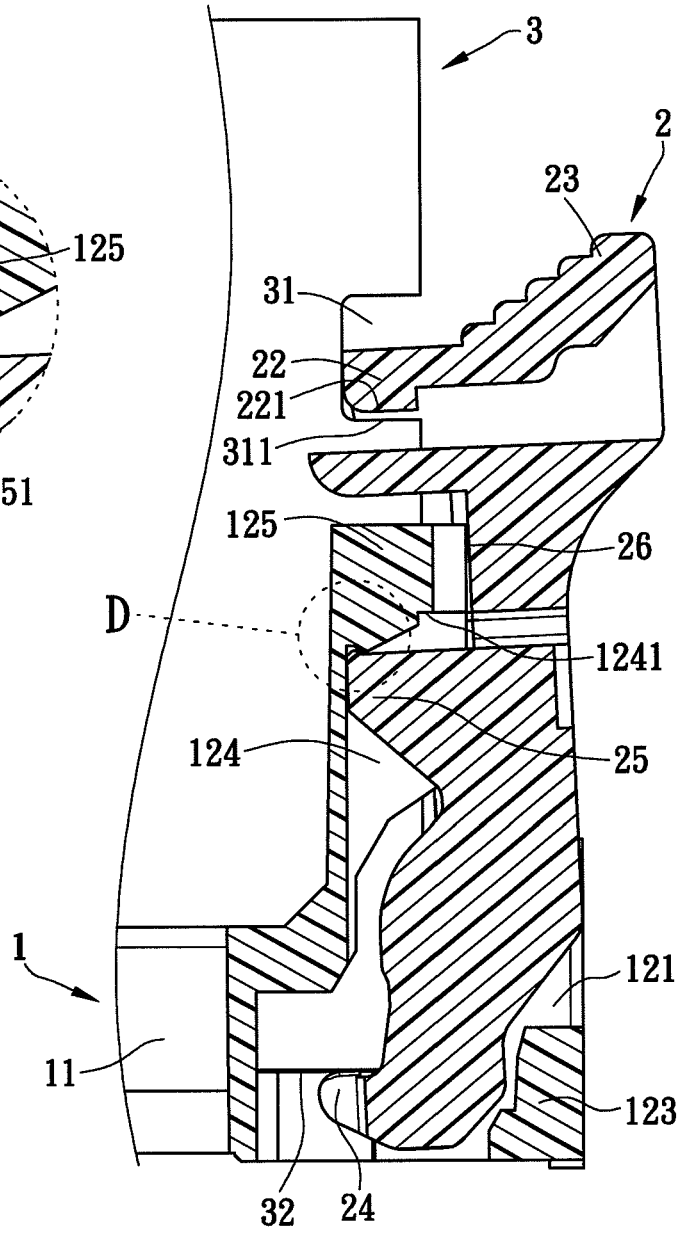
FIG. 9 is a schematic view illustrating further rotation of a fastener towards an electrical receptacle when the card edge connector with a card-disengagement-preventing function engages with the electronic card.

Referring to FIGS. 8 and 9, a second embodiment of the card edge connector with a card-disengagement-preventing function of the present invention is shown therein. The second embodiment differs from the first embodiment in that:

The protrusion 27 is arc-shaped. Of course, the shape of the protrusion 27 may also be of other shapes rather than being merely limited to the shape depicted in this embodiment.

The first connecting portion 1253 is an inclined surface inclined downwards away from the central perpendicular line 112. Of course, the first connecting portion 1253 may also be a flat surface, or be a point, as seen from a front view, formed by connection of the inclined surface 1251 with the abutting surface 1252.

The surface of the projection 125 is further formed with a connecting surface 1254, which is disposed horizontally and is nearer to the central perpendicular line 112 than the abutting surface 1252. The connecting surface 1254 has an end thereof connected to the abutting surface 1252, with a second connecting portion 1255 higher than the first connecting portion 1253 being formed at the juncture therebetween. The connecting surface 1254 has the other end thereof connected to an interior sidewall of the recess 124, with a movement space 1256 being formed by the connecting surface 1254, the abutting surface 1252 and the interior sidewall of the recess 124.

Of course, in other embodiments, it may also be that the connecting surface 1254 and the abutting surface 1252 are disposed in line with each other, or the connecting surface 1254 and the inclined surface 1251 are inclined downward in the same direction; and it may also be that the recess 124 extends through the sidewall 122, or the interior sidewall of the recess 124 extends through a sidewall opposite to the end wall 123, or the recess 124 extends through the sidewall opposite to the end wall 123 while the interior sidewall of the recess 124 extends through the sidewall 122.

When the fastener 2 is snap-fitted into the electrical receptacle 1, the protrusion 125 enters the movement space 1256 along the inclined surface 1251, and when the protrusion 27 is located in the movement space 1256, the protrusion 27 is higher than the first connecting portion 1253.

When the operational portion 23 is pulled, the fastener 2 is snap-fitted to the tower portion 12. As a result, the detent portion 22 is snap-fitted into the snap-fitting portion 31, the abutting portion 25 enters the bottom portion of the recess 124, and the protrusion 27 passes through the inclined surface 1251 and is then guided by the first connecting portion 1253 into the movement space 1256 formed by the connecting surface 1254, the abutting surface 1252 and the interior sidewall of the recess 124 to abut against the abutting surface 1252. Also, a gap 5 is formed between the connecting section 26 and the tower portion 12, the separation 6 is formed between the abutting portion 25 and the recess 124 in the lateral direction, and a slit exists between the snap-fitting surface 221 and the fastened surface 311. As shown in FIG. 9, because the gap 5 is formed between the connecting section 26 and the tower portion 12 and the separation 6 exists between the abutting portion 25 and the recess 124, the fastener 2 will, owing to the rotation inertia, continue to rotate towards the electrical receptacle 1 until the snap-fitting surface 221 abuts against the fastened surface 311.

Figure 10A:
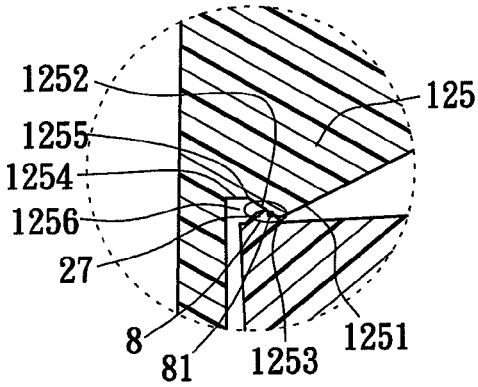
FIG. 10A is an enlarged view of a position E shown in FIG. 10.
Figure 10:
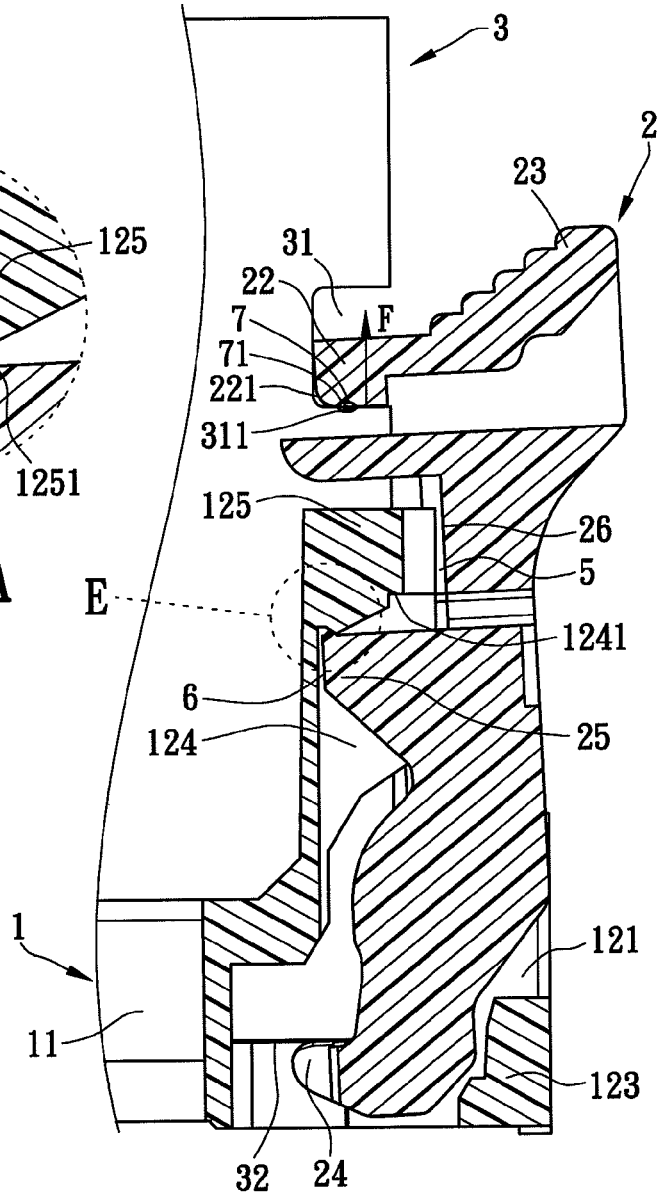
FIG. 10 is a schematic view illustrating rotation of the fastener towards a central perpendicular line if the electronic card is subjected to an external force when the card edge connector with a card-disengagement-preventing function of the second embodiment of the present invention engages with the electronic card.
Figure 11A:
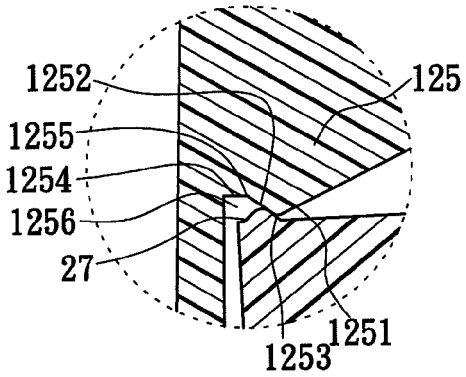
FIG. 11A is an enlarged view of a position F shown in FIG. 11.
Figure 11:
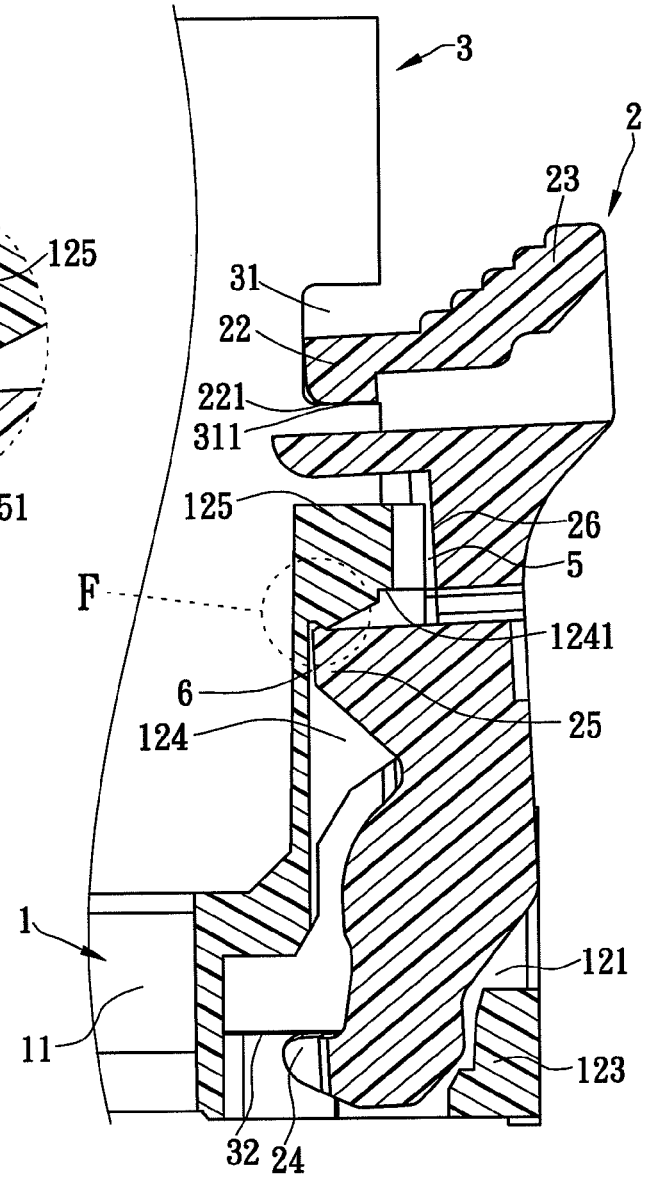
FIG. 11 is a schematic view illustrating outward rotation of the fastener under an external force when the card edge connector with a card-disengagement-preventing function of the second embodiment of the present invention engages with the electronic card.

When an abutting force F is applied, this embodiment also delivers the same effects as the first embodiment. In this respect, reference may be made to FIG. 10, and no description will be further made herein. Additionally, this embodiment further delivers the following effects:

Referring to FIG. 11, when subjected to a lateral external force that tends to rotate the fastener 2 away from the central perpendicular line 112, the fastener 2 will be rotated outwards. As the protrusion 27 is higher than the first connecting portion 1253, the protrusion 27 will be blocked and guided by the abutting surface 1252 to move upward, thereby ensuring the snap-fitting between the detent portion 22 and the snap-fitting portion 31 to improve the snap-fitting capability. At this point, the snap-fitting surface 221 and the fastened surface 311 assume a tight fit relationship therebetween.

Figure 12A:
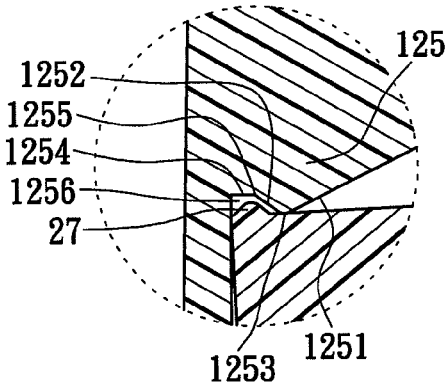
FIG. 12A is an enlarged view of a position G shown in FIG. 12.
Figure 12:
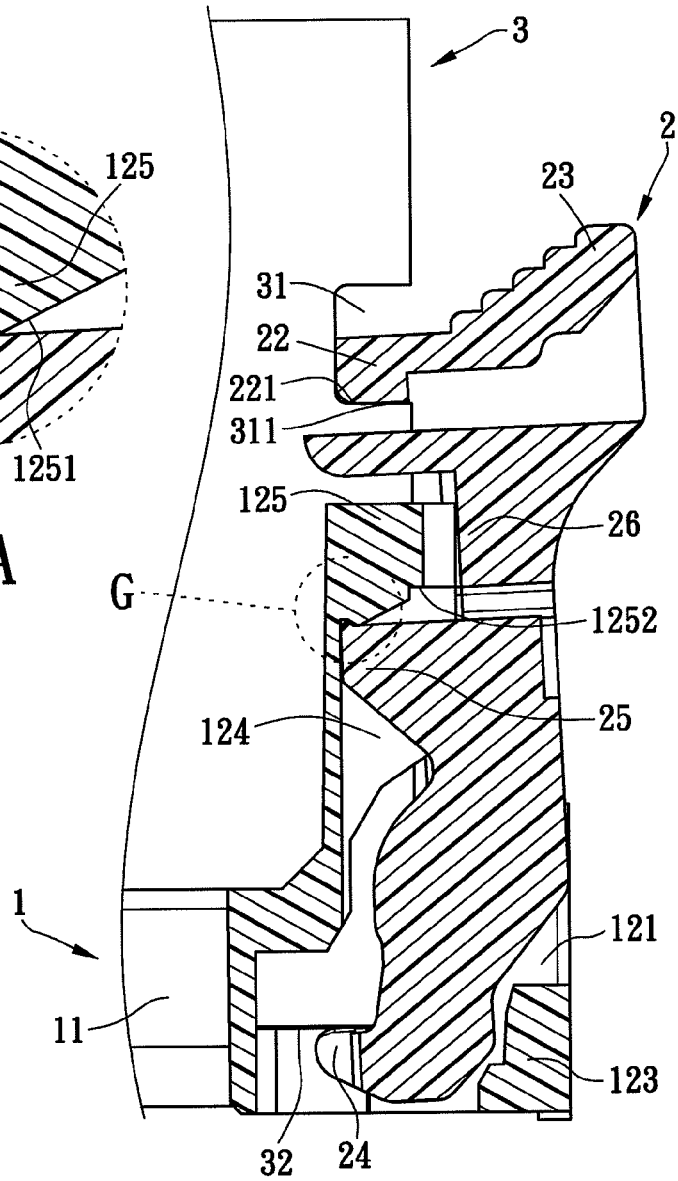
FIG. 12 is a schematic view illustrating rotation of the fastener by the electronic card subjected to a lateral external force when the card edge connector with a card-disengagement-preventing function of the second embodiment of the present invention engages with the electronic card.

Referring to FIG. 12, when the electronic card 3 is subjected to the lateral external force, because the snap-fitting portion 31 of the electronic card 3 is snap-fitted to the detent portion 22 of the fastener 2, movement of the electronic card 3 under the action of the lateral external force will also drive the fastener 2 to move together. As the electronic card 3 fixedly inserted in the slot 111 can only apply a limited lateral pushing force to the fastener 2 under the action of the lateral external force, the electronic card 3 has a tendency to move upward, causing the protrusion 27 of the fastener 2 to be guided by the abutting surface 1252 to move toward the movement space 1256 formed by the connecting surface 1254, the abutting surface 1252 and the interior sidewall of the recess 124 until the surface of the abutting portion 25 abuts against the first connecting portion 1253. At this moment, the fastener 2 stops moving upward, and the snap-fitting surface 221 and the fastened surface 311 assume a tight fit relationship therebetween.

In summary, the card edge connector with a card-disengagement-preventing function of the present invention has the following advantages:

1. The first distance is greater than the second distance, so before operating the fastener to detach it from the snap-fitting portion, once the electronic card is pulled opposite to the direction in which it is inserted into the electrical receptacle, the fastened surface of the electronic card will push against the snap-fitting surface and apply an upward abutting force thereto to move the fastener upward. Once the fastener is moved to a certain height, the protrusion will abut against the abutting surface to form the abutting area and to prevent the fastener from further moving upward. Thus, with the abutting point as a fulcrum, a torque corresponding to the abutting force is generated on the fastener to rotate the fastener towards the central perpendicular line, thereby ensuring that the detent portion and the snap-fitting portion are snap-fitted with each other and improving the snap-fitting capability. Accordingly, disengagement of the electronic card from the electric receptacle is prevented.

2. A clearance, which is farther away from the central perpendicular line than the pivot portion, is formed in a lateral direction between the pivot hole and the pivot portion. Disposition of the clearance allows the pivot portion to rotate correspondingly when the fastener is rotating towards the central perpendicular line with the abutting point as a fulcrum. This further improves the snap-fitting capability by enhancing the effect of rotating the fastener towards the central perpendicular line.

3. Each of the tower portions is formed with a recess in which an abutting surface and a connecting surface connected with each other are provided, and at a side of the abutting surface, a movement space is formed by the abutting surface, the connecting surface and an interior sidewall of the recess. Therefore, when the fastener is subjected to a lateral external force, the protrusion of the abutting portion, as blocked by the abutting surface, can only be guided by the abutting surface to move upward so as to move inside the movement space. In this way, detachment of the fastener from the electrical receptacle is prevented, thereby ensuring the normal electrical connection of the electronic card with the electrical receptacle.

4. When the electronic card is subjected to the lateral external force, because the snap-fitting portion of the electronic card is snap-fitted to the detent portion of the fastener, outward movement of the electronic card under the action of the lateral external force will also drive the fastener to move together. As the electronic card fixedly inserted in the slot can only apply a limited lateral pushing force to the fastener under the action of the lateral external force, the electronic card has a tendency to move upward, causing the protrusion of the fastener to be guided by the abutting surface to move toward the movement space formed by the connecting surface, the abutting surface and the interior sidewall of the recess until the surface of the abutting portion abuts against the first connecting portion. At this moment, the fastener stops moving upward so that the fastener will not be detached from the electrical receptacle.

5. Because when the fastener is snap-fitted to the electrical receptacle, the abutting portion goes into the movement space of the tower portion and the protrusion is higher than the first connecting portion, it is guaranteed that the abutting surface can serve as a blocking structure as soon as the fastener goes into the recess of the tower portion. Thus, when the card edge connector of the present invention is subjected to the lateral external force, detachment of the electronic card from the electrical receptacle as wound occur if there were not the blocking structure can be prevented.

The above descriptions are only provided to explain preferred embodiments of the present invention but not to limit scope of the claims of the present invention. Accordingly, equivalent changes or modifications that can be made without departing from technical spirits of the present invention will still fall within scope of the present invention.

What is claimed is:

1. A card edge connector for an electronic card to be inserted therein, wherein the electronic card is provided with a snap-fitting portion on at least one side thereof and the snap-fitting portion is formed with a fastened surface, the card edge connector being characterized in that it comprises:

an electrical receptacle, being formed with a slot for the electronic card to be inserted therein, wherein the electrical receptacle is provided with a tower portion extending upward on at least one side thereof, and the tower portion is formed with an abutting surface facing downward;

at least one fastener, being provided with at least one pivot portion for movably pivoted to the electrical receptacle, wherein the fastener is further provided with a detent portion which is formed with a snap-fitting surface, the detent portion pivots about the pivot portion to be snap-fitted with the snap-fitting portion, the snap-fitting surface is exactly located above the fastened surface and makes contact with the fastened surface to form a fastening area, the fastening area has a contact point that is closest to a central perpendicular line of the electrical receptacle and the contact point has a first shortest distance from the central perpendicular line; and wherein the fastener is provided with an abutting portion between the pivot portion and the detent portion, the abutting portion is located exactly beneath the abutting surface when the detent portion is snap-fitted to the snap-fitting portion, a top surface of the abutting portion abuts against the abutting surface to form an abutting area, the abutting area has an abutting point that is closest to the central perpendicular line, and the abutting point has a second shortest distance from the central perpendicular line which is less than the first shortest distance;

whereby, before the fastener is operated to be detached from the snap-fitting portion, in case the electronic card is subjected to a force opposite to a direction in which the electronic card is inserted, the fastened surface of the electronic card will push against the snap-fitting surface to drive the abutting point of the abutting portion to abut against the abutting surface correspondingly, and with the abutting point as a fulcrum, a torque is generated from the abutting force to rotate the detent portion of the fastener towards the central perpendicular line, thereby improving the snap-fitting capability.

2. The card edge connector according to claim 1, being characterized in that: the fastener is provided with a connecting section for connecting the detent portion and the abutting portion, and a gap is formed between the connecting portion and the tower portion.

3. The card edge connector according to claim 1, being characterized in that: the abutting surface is an inclined surface that is inclined downwards in a direction away from the central perpendicular line.

4. The card edge connector according to claim 1, being characterized in that: a protrusion is protruded upward from the abutting portion, and the abutting points are formed by a top surface of the protrusion and the abutting surface.

5. The card edge connector according to claim 1, being characterized in that: the electrical receptacle is formed with at least one pivot hole into which the pivot portion is pivoted.

6. The card edge connector according to claim 5, being characterized in that: the pivot portion and the pivot hole mate with each other slidably so that relative movement can occur between the fastener and the electrical receptacle.

7. The card edge connector according to claim 5, being characterized in that: the pivot portion is a pivot extending from two opposite sides of the fastener respectively and is pivoted into the pivot hole correspondingly.

8. The card edge connector according to claim 5, being characterized in that: a clearance is formed in a lateral direction between the pivot hole and the pivot portion, and the clearance is farther away from the central perpendicular line than the pivot portion.

9. The card edge connector according to claim 8, being characterized in that: a positioning block extends from the clearance at the bottom of the pivot hole to abut against the pivot portion.

10. The card edge connector according to claim 1, being characterized in that: the tower portion of the electrical receptacle is formed with at least one recess whose inner top end forms the abutting surface, and when the detent portion is snap-fitted into the snap-fitting portion, the abutting portion enters the recess exactly.

11. The card edge connector according to claim 10, being characterized in that: a lateral separation exists between the abutting portion and the recess.

12. The card edge connector according to claim 10, being characterized in that: a projection projects downward from the inner top end of the recess, and a surface of the projection forms the abutting surface.

13. The card edge connector according to claim 12, being characterized in that: the projection has an inclined surface that is inclined downward towards the central perpendicular line, the inclined surface and the abutting surface are connected with each other, and a first connecting portion is formed therebetween.

14. The card edge connector according to claim 13, being characterized in that: the first connecting portion is a flat surface.

15. The card edge connector according to claim 13, being characterized in that: the first connecting portion is an inclining surface.

16. The card edge connector according to claim 12, being characterized in that: the projection has a connecting surface, one end of the connecting surface is connected with the abutting surface, and the other end of the connecting surface is connected with an interior sidewall of the recess, a second connecting portion is formed between the connecting surface and the abutting surface, a movement space is formed by the connecting surface, the abutting surface and the interior sidewall of the recess.

17. The card edge connector according to claim 16, being characterized in that: the connecting surface is disposed horizontally.

18. The card edge connector according to claim 16, being characterized in that the connecting surface and the abutting surface are inclined downward in the same direction.

19. The card edge connector according to claim 1, being characterized in that: the pivot portions are pivots extending from two opposite sides of the fastener, and the pivots respectively and pivotedly connected with opposite sides of the tower portion.

20. The card edge connector according to claim 1, being characterized in that: the fastener is formed with two symmetrical abutting portions which extend away from each other gradually.

* * * * *